United States Patent [19]

Gustavsson et al.

[11] 4,079,659

[45] Mar. 21, 1978

[54] DEVICE FOR TRANSFERRING AMMUNITION FOR TANK

[75] Inventors: Lars G. T. Gustavsson; Sven-Hakan Svensson, both of Karlskoga, Sweden

[73] Assignee: AB Bofors, Bofors, Sweden

[21] Appl. No.: 722,255

[22] Filed: Sep. 10, 1976

[30] Foreign Application Priority Data

Sep. 12, 1975 Sweden ..... 7510203

[51] Int. Cl.[2] ..... F41H 7/06

[52] U.S. Cl. ..... 89/46; 89/47

[58] Field of Search ..... 89/33 A, 33 B, 33 BB, 89/33 SF, 34, 36 H, 36 K, 36 L, 40 B, 45, 46, 47

[56] References Cited

U.S. PATENT DOCUMENTS

| | | | |
|---|---|---|---|
| 947,600 | 1/1910 | Schneider | 89/47 |
| 2,690,700 | 10/1954 | Turner | 89/36 H |
| 2,785,607 | 3/1957 | Henström et al. | 89/36 H |
| 2,803,499 | 4/1958 | Even | 89/36 H |
| 3,142,226 | 7/1964 | Carlsson | 89/45 |

FOREIGN PATENT DOCUMENTS

| | | | |
|---|---|---|---|
| 2,149,954 | 4/1973 | Germany | 89/40 B |
| 15,659 of | 1898 | United Kingdom | 89/46 |

*Primary Examiner*—Stephen C. Bentley
*Attorney, Agent, or Firm*—Pollock, Vande Sande & Priddy

[57] ABSTRACT

A loading pendulum picks up an ammunition round from a magazine fixed to a tank body, traverses around the tank to the position of the tank gun, raises the round into the recoil housing of the gun and, following ramming returns to the magazine for the next round.

75 Claims, 6 Drawing Figures

DEVICE FOR TRANSFERRING AMMUNITION FOR TANK

BACKGROUND OF THE INVENTION

The present invention relates to a device for transferring rounds of ammunition for a large calibre firearm mounted on a tank from their position in a magazine mounted on the tank body to the ramming position at a position separate from the magazine on the top or turrent of the tank.

For tanks of the kind in question, in certain cases there are requirements for a high positioning of the barrel so that, for example, both large angles of depression and elevation can be obtained, and for full circle traversing of the firearm in relation to the tank chassis. In general, there is also a desire to have the tank carry its ammunition in a low position, which, requires the ammunition magazine on the tank to be placed comparatively low under the firearm and its breech ring. In such a situation transfer of rounds of ammunition from the magazine to the firearm can become comparatively complicated and will therefore constitute a negative factor when the transfer of rounds is to be automatic and is to take place at great speed. These difficulties become still more prominent in cases when the magazine is fixed to the tank and the firearm is traversable in relation to the tank chassis.

OBJECTS AND SUMMARY OF THE INVENTION

The present invention is primarily directed towards these problems, and is intended to create a device with which the problems posed are solved. A feature which can be considered to be significant for a device according to the invention comprises a round-carrying unit which during the transfer of the rounds has at least its parts which coact with the round located outside (above) the tank.

Further developments of the concept of the invention are specially directed towards the problems involved in transferring rounds from a magazine which is fixed to the tank chassis and cannot traverse to a firearm which is traversable in relation to the tank chassis. More specifically, use of a unique pendulum is proposed which is rotatably arranged around a turning center and can be moved in the traverse direction along an arc which has its center in the traversing axis of the firearm. The loading pendulum is rotatable in relation to the tank chassis as well as the firearm in a plane at right angles to the traversing axis of the firearm, and is also elevatable above in this plane. In this way, the loading pendulum can be given a magazine position, independent of the traverse position of the firearm, where rounds are received from the magazine followed by a swinging in to a position in traverse corresponding to the traverse position of the firearm, after which a turning up to the ramming position completes the procedure for the transfer of a round. In a specific further development, the parts of the loading pendulum which coact with the round are enclosed in a shaft with sealing covers that can be turned up and down. The pendulum assumes magazine position which also is the rest position below the covers within the shaft for the pendulum when it is not being used. The pendulum is raised before swinging the traverse to a position where the traversing of the pendulum can take place plane without its hitting the tank, parts extending from the tank or the under side of the firearm. In order to facilitate the application of parts belonging to the tank and/or the designing of the tank itself, it is also conceivable to allow the loading pendulum to swing in a wavy traversing plane.

BRIEF DESCRIPTION OF THE DRAWINGS

The invention will be described with reference to the accompanying drawings, in which.

DETAILED DESCRIPTION OF THE PREFERRED EMBODIMENT

Figure 1:
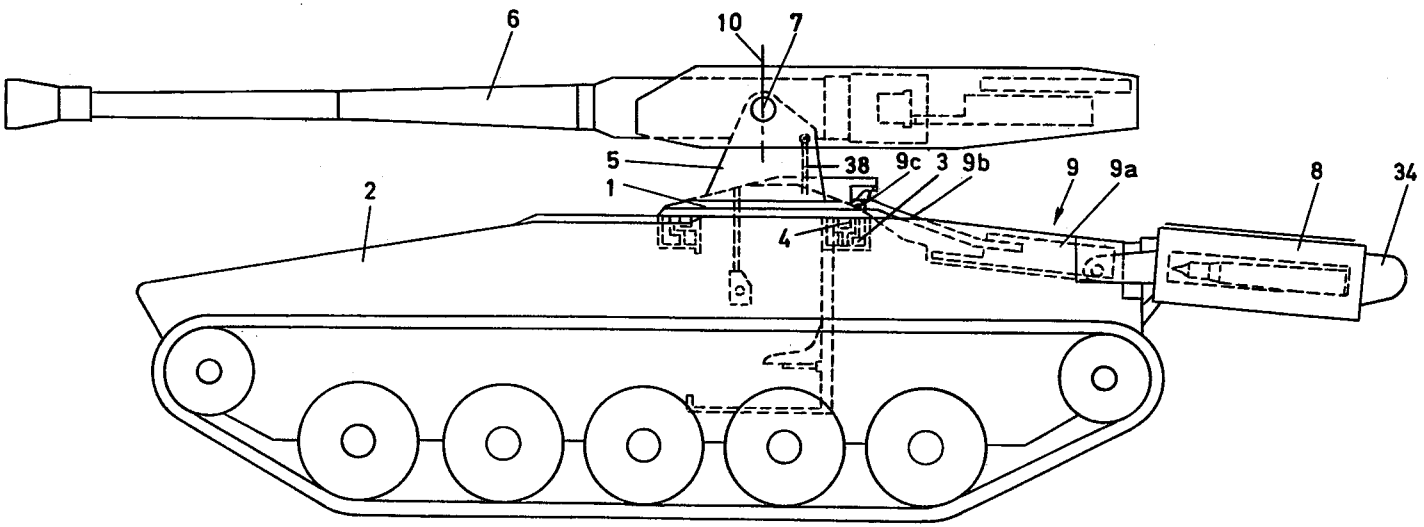
FIG. 1 shows a side view, partly in phantom, of a tank embodying the invention
Figure 2:
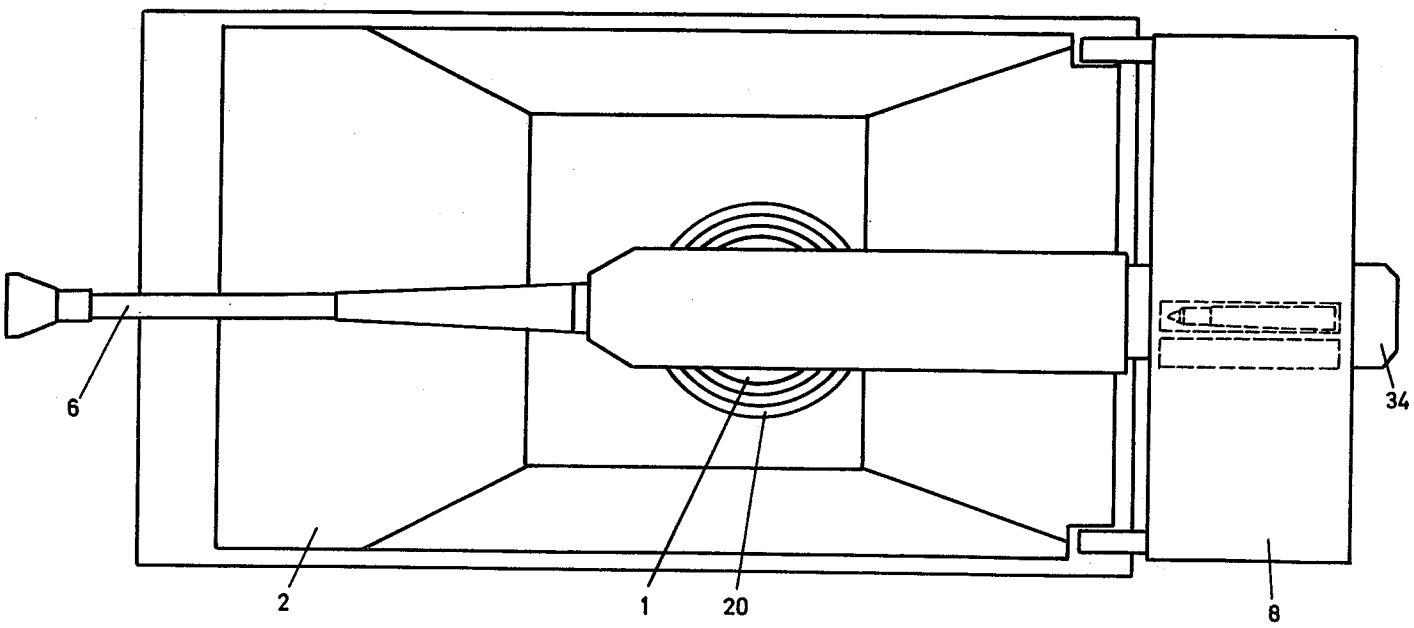
FIG. 2 shows a top view of the tank according to FIG. 1.
Figure 3A:
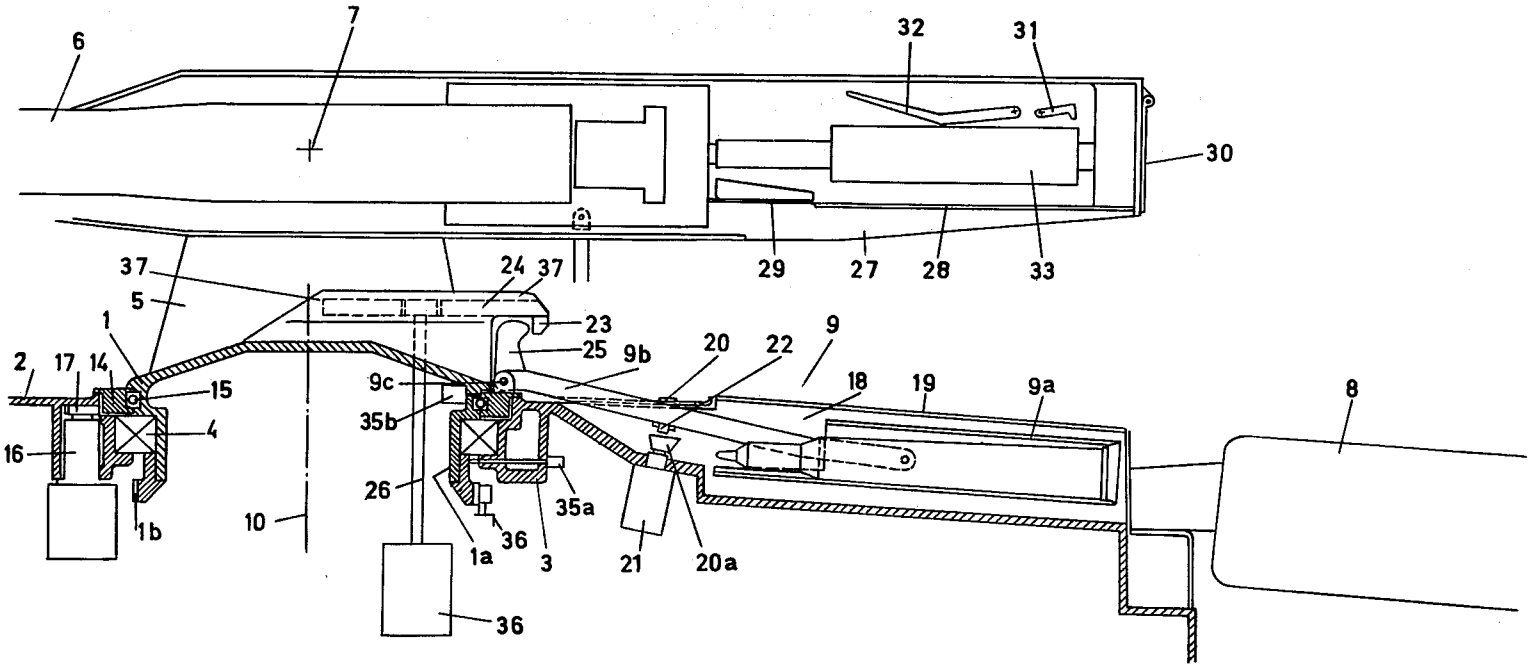
FIG. 3*a* shows an elevation view, partly in cross-section, of the loading pendulum according to the invention.
Figure 3B:
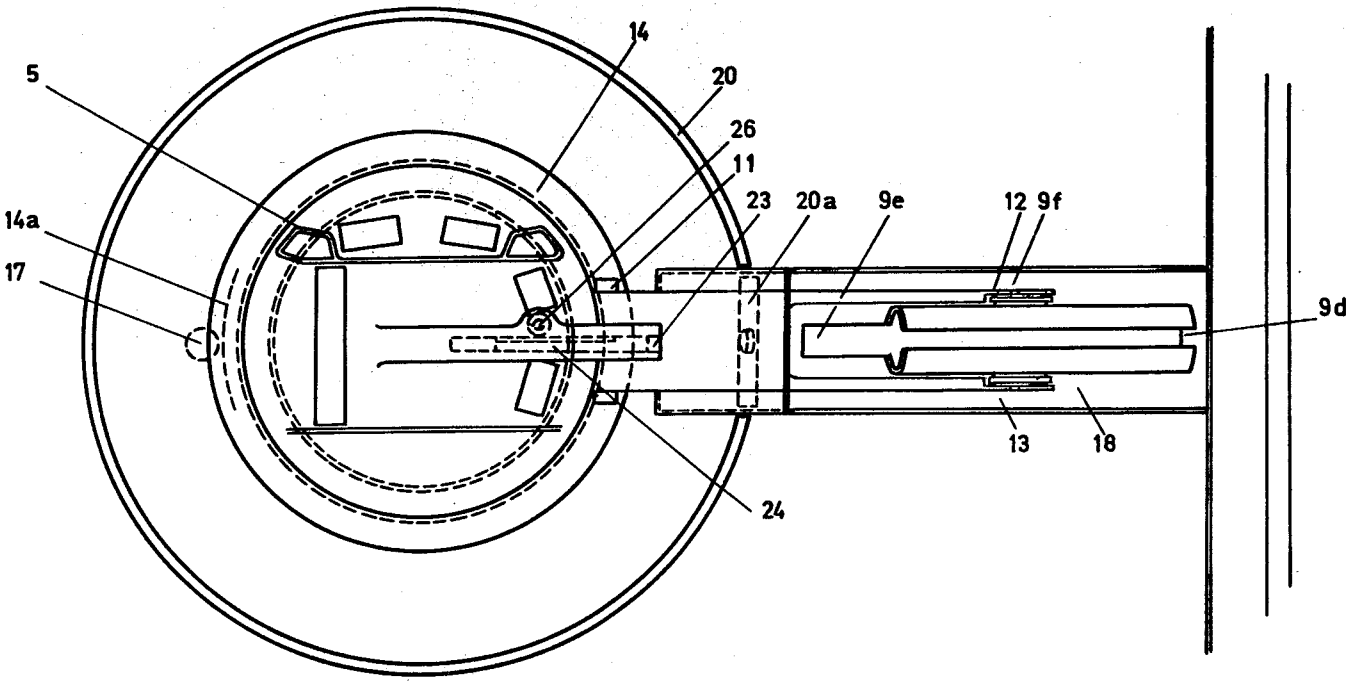
FIG. 3*b* shows a top view of the leading pendulum indicating its relation to the tank turrent.
Figure 3C:
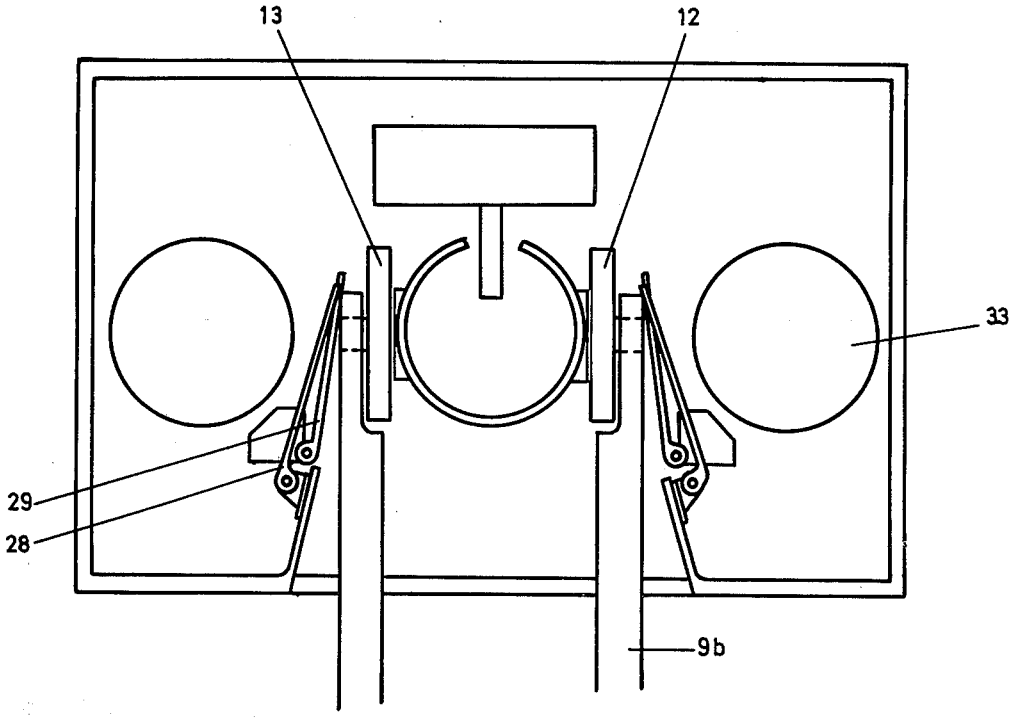
FIG. 3*c* shows a sectional view through the recoil housing of the gun, indicating the pendulum in the ramming position.
Figure 4:
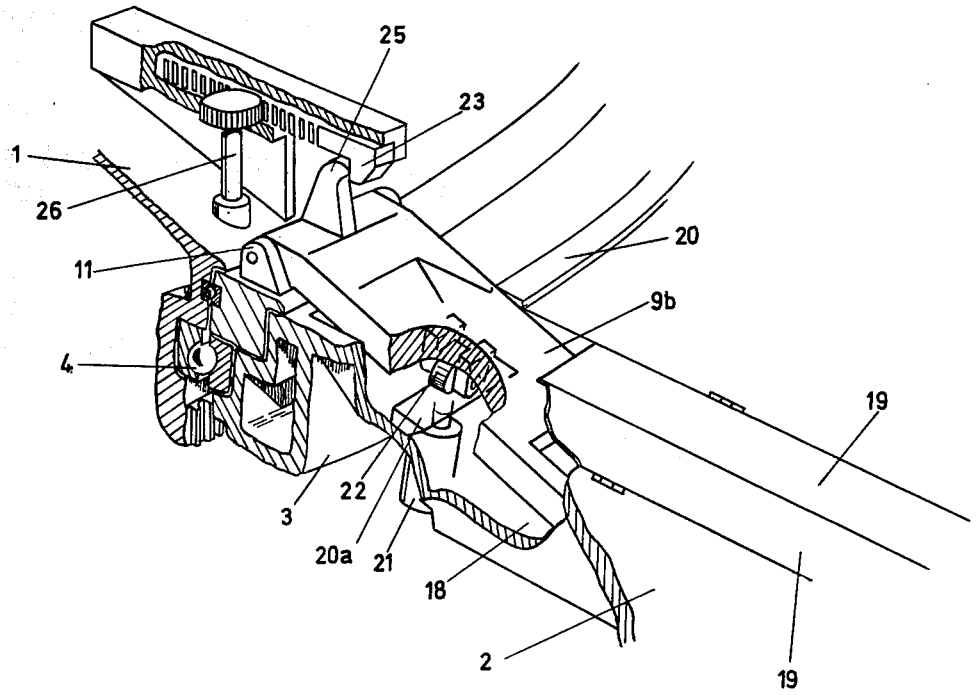
FIG. 4 shows a perspective view, partly broken away, of some of the parts of the tank illustrated in FIGS. 3*a*–3*b*.

FIGS. 1, 2 and 3*a* illustrate a tank provided with a small turret 1, a so-called miniturret, which is rotatably mounted in a frame 3 arranged in a tank chassis 2 via a ball bearing 4 mounted on a downwardly extending portion 1*a* of the turret. The miniturret has only a small vertical height above chassis 2, and is made with upper parts which are to a slight extent above the other parts of the top of the tank. Likewise, the miniturrent has only a limited extent downwards. Under the turret, inside the tank, a seat is arranged as well as a foot plate for a crew member. The seat and plate are connected to the turrent from below via a fastening member; so that they follow its movements in tranverse in relation to the tank. On the top of the turrent a cradle carrier is fastened comprising side parts 5 for trunnions 7 for a large-calibre (e.g. 105 mm) firearm 6. The vertical height of the side parts 5 corresponds esssentially to onehalf the overall height of the turrent which, together with their position on the turret provides that the firearm will have a marked high position on the tank. The firearm thereby may be moved to comparatively large angles of depression and elevation. The elevation and depression of the weapon are performed by means of an elevation rod which extends down into the tank where it can be actuated with a motor via a gear device. The side parts 5 are provided with recesses for side viewing apertures on the turret. Furthermore, farthest to the rear, the tank is provided with a so-called externally suspended magazine 8 for ammunition carried in the tank in the form of a number of rounds which can be fed out via one or two feed-out positions on the magazine, depending on the internal embodiment and disposition of the magazine. The magazine is rotatably suspended in the tank so that when the tank is moving over uneven ground it can be swung upward out of the way. In its normal position when the tank is firing the upper side of the magazine is essentially in the same plane as the upper side of the tank at the rear parts. Thus, during transfer of round from the magazine the magazine is placed comparatively far below the ramming position at the recoil housing of the firearm. The front edge of the magazine is somewhat behind the rear edge of the rear parts of the firearm.

In the space located in front of the magazine and between the lower parts of the firearm and the upper parts of the top of the tank a loading pendulum 9 is arranged as shown in FIG. 1. Pendulum 9 has a round receiving sections 9*a* and an arm 9*b* which supports section 9*a* and a fork-shaped front part. The pendulum is rotatably around a turning centre 9*c* at the other end of arm 9*b*. Turning center 9*c* is located below and at the rear of the trunnions 7 of the firearm in the position shown in FIG. 1. Since turning centre 9*c* can be moved about the turret axis to the position of the firearm, the loading pendulum is also rotatably arranged in relation to the tank chassis and the firearm (the turret) around a traversing axis which coincides with the traversing axis 10 of the firearm. In this way, the loading pendulum, independent of the elevation and vertical position of the firearm can be set in a magazine position (see FIG. 1) where rounds can be fed into the pendulum, after which the pendulum can be swung in the traversing direction to the traverse position of the firearm, where the movement of the pendulum, to the ramming position, takes place.

FIGS. 3*a*–3*c* and 4 show the function and design the loading pendulum and turret in more detail. The round receiving sections 9*a* of the loading pendulum comprise of an armour tube which has a longitudinal upper through slot 9*d* which provides for coaction with the rammer unit in the ramming position. At its front part, the loading pendulum is made with an extended bottom part 9*e* which is directed towards the turning centre 9*c* for the pendulum. The pendulum supports the round with the front parts of the round resting against extended bottom part 9*e*. The arm 9*b* is supported at one end on a journal which extends at right angles to the arm and is supported in bearing brackets 11. At its other end, arm 9*b* has a fork-shaped section, the prongs of which extend on either side of the armour tube to the central parts of the armour tube, where a rotatable connection is made by means of fastening journals which extend out from the armour tube. At the fastening journals, helical springs 12, 13 are arranged on either side of the tube, which helical springs are arranged to keep the armour tube essentially parallel to the barrel even after it has been turned up from the magazine position. This fixing of the position by means of the helical springs is intended to prevent such an oblique position of the armour tube at the turning movement in the traversing plane that the rear or front parts of the armour tube would hit the top of the tank and/or the underside of the barrel. On either side of the armour tube, the helical springs are fastened to the armour tube and the prongs 9*b* of the arm in such a way that one spring strives to turn the tube clockwise and the other spring strives to turn the tube counter-clockwise. The rotatable fastening of the arm is necessary due to the fact that the pendulum and the firearm have different elevation bearings, and that the armour tube must be capable of adapting itself to the different elevation positions of the barrel.

The bearing brackets 11 of the pendulum are fastened to a ring 14 which via ball bearings 15 is rotatably fastened in relation to the turret 1; and particularly via a further ball bearing, in relation to the fixed frame 3 of the tank chassis. The frame 3 has a box-shaped cross-section with a special design which permits the application of ring, turret, ball bearing and frame favourably from the point of view of protection and functioning in relation to each other. The turret is made with an overlapping flange at the ring which in the corresponding way is provided with an overlapping flange at the frame so that contamination is prevented from entering between the parts in question. The turret, ring and frame moreover have positions at such levels in relation to each other that e.g. water will have a certain path to run off along the different parts.

The swinging movements of the loading pendulum are thus achieved by means of the turning of the ring around is centre line which coincides with the axis 10. The ring 14 is made with an outer gear arc 14*a*, not shown in detail, via which the ring can be driven by means of a hydraulic or an electric motor, the shaft part of which is designated 16, while the driving teeth of the shaft are designated 17. The shaft part 16 and the gear 17 are arranged in recesses in the box-shaped frame 3. The turret 1 also has an external gear arc 1*b* at its part 1*a* which extends down into the tank.

The armour tube 9*a*, in the magazine position of the loading pendulum, i.e. the position according to FIG. 1, is intended to extend along with the rear part of arm 9*b* down into a special shaft 18 made in the tank chassis. The shaft is made with sealing covers which can be opened and closed. When the pendulum is raised from the magazine position the covers open upwards and when the pendulum goes down into the shaft the covers can be closed again, so that effective sealing against contamination is obtained. When the loading pendulum swings around the axis 10, it is supported on a fixed and essentially circular slide track 20. In order to permit the armour tube to go down into the shaft, however, the arm 9*b* will need to cross the slide track. The slide track is therefore made with a small part 20*a* which can be lowered to a level below the other part of the slide track. Said part 20*a* is located in front of and above the front parts of the shaft. The raising and lowering of the slide track 20*a* between the positions where the armour tube is lowered into the shaft and where the armour tube is swung up from the shaft is carried out by means of a control device 21 in the form of a lifting cylinder or the like. The loading pendulum coacts with the slide track via a wheel 22 or a corresponding part which is arranged in the arm with its supporting axis coinciding with or parallel to the longitudinal direction of the arm. When the pendulum is swung along the slide track 20, it is assumed to clear the upper parts of the tank and the lower parts of the firearm. In the case shown, a planar slide track has been foreseen. However, it is, of course, conceivable to give the slide track different height levels along different parts of its extent so that the pendulum can be considered to swing in a wavy lateral plane. The wheel is located on the arm at the inner half of this, e.g. at a distance from the turning centre 9*c* which is essentially equal to one third of the length of the arm.

In the raised position, where the loading pendulum can coact with the entire slide track, in accordance with the design shown, the loading pendulum is adjustable via the gear 17 to a traversing position which coincides with the traversing position of the firearm. In said coinciding traverse positions, the pendulum can be swung up from the position coacting with the slide track to the ramming position at the firearm. This swinging up about the point 9*c* is carried out by means of a pulling part 23 supported in the turret in the form of a hook fastened in one end of a straight gear rack 24. In said coinciding traverse position, the hook can coact with a member 25 fixed to the pendulum arm which in the coinciding traverse positions will be exactly opposite the hook 23. The movement of the gear rack is achieved with a motor via its driving shaft 26.

In the case shown, the recoil jacket 27 of the firearm is provided with lower covers 28, and covers 29 are fastened to the breech ring. Said covers 28 and 29 are intended to provide a seal against the entry of foreign objects when firing is not taking place, and at the same time with their insides to constitute surfaces for empty cartridge cases when these are ejected, which takes place via a cover 30 arranged at the rear section of the recoil jacket which is pushed outwardly by the cartridge cases from the inside and falls down of its own weight. As will be noted from FIG. 3*a*, the covers 28 and 29 can be swung up by means of the loading pendulum when this enters from below in relation to the recoil jacket and the breech ring. The covers 28 and 29 are arranged at different levels, so that they can be pushed over each other at the recoil.

Because of the different supporting points for the elevation movements for the firearm and the pendulum, a space which exceeds the length of the armour tube will be necessary at the ramming position inside the recoil jacket. The ramming movement will also be comparatively long, and therefore, in the present case, so-called two-stage ramming has been chosen. In the first stage, a first ramming arm 31 first moves the round a predetermined distance and thereafter a second ramming arm 32 moves the round the rest of the way into the chamber. The two-stage rammer used is made in such a way that is permits smooth ramming. By ramming position is meant the position the round has before the ramming arms 31, 32 enter into coaction with the round. The recoil buffers have the designation 33.

The magazine 8 is also made with a rammer 34 which, as in the case described above, includes a two-stage rammer that can be made in a way which is known in itself. The rammer 34 moves the round out of the magazine and into the armour tube.

The magazine can be made with one or two feed-out positions for rounds. When there is one feed-out position, the position of the armour tube in the shaft will be one and the same. In the case of two feed-out positions arranged close to each other, the shaft is made comparatively wider, so that the armour tube can perform a small lateral movement in the shaft between two different angular position, where the loading pendulum in one of the angular positions is opposite one of the feed-out positions and in the other angular position is opposite the other feed-out position.

The magazine can be made in two different part units which have different kinds of ammunition. On the basis of the design of the magazine and the disposition within the magazine, one or two feed-out positions may be chosen.

Briefly, the equipment described above functions in the following way. The loading pendulum is set in the magazine position according to FIG. 3 so that a round can be fed into it or has been fed into the armour tube from the magazine by means of the rammer 34. Thereafter the pendulum is turned up out of the shaft in connection with the covers being opened, particularly by means of the armour tube. It is also possible to have the covers open while firing is being carried out. The turning up takes place by means of the hydraulic cylinder 21. Thereafter the ring 14 is turned via the gear 17 so that the loading pendulum assumes the traverse position of the firearm. Thereafter the pendulum is turned up further by means of the gear rack 26 to the position where the round is moved out of the loading pendulum by the rammer, and in the reverse order in relation to the one described above it can return to the magazine to fetch a new round.

In accordance with what is stated above, the driving can take place by means of hydraulic or electric motors, and these in the case of the electric motors can be driven by the spare batteries in the tank, so that they will not be dependent on whether or not the engine of the tank is running. When a gun which has been deflected more than 45° from the direction in which the tank is being driven is loaded, the loading pendulum will swing outside the tank, but not more than approx. 0.5 m outside the side of the tank.

The loading procedure described will be fully automatic, and can be carried out very rapidly. For guidance of the loading pendulum in the traverse direction, mechanical blocking devices should appropriately by used, which are activated when the angles of traverse of the pendulum and the firearm coincide, but which are disactivated when the pendulum is to return to fetch a new round. The guidance is also carried out in such a way that the pendulum takes the shortest way in traverse, which involves that the blocking devices must be made so that they can function for both directions of swinging. Examples of such blocking devices are designated 35*a* and 35*b*. The blocking devices can be made in many alternative ways, and in the turret they consist of plungers to can be activated which coact with holes in the ring 14. In the case shown, both the turret and the tank chassis are provided with movable plungers (35*a* and 35*b*) which coact with holes in the ring. The plungers are controlled by electromagnets or hydraulic cylinders in order to achieve the deactivation function. The deactivation can, for instance, also be carried out by means of the member 25 which in the ramming position is entirely retracted by the hook 24, and the member in the entirely retracted position is arranged to actuate the plungers for deactivation. It is also conceivable to use a gripping fork which in the traversing position in question engages the member 25 and which is moved aside by the member in its entirely retracted position. The traversing of the turret and the firearm is achieved by means of a driving motor 36. When swinging in to the ramming position, the rear/upper parts of the armour tube will first hit the top at the recoil jacket, and will then finally be adapted to the present angle of elevation of the firearm. In the corresponding way, the rear/-lower section of the armour tube will hit the bottom of the shaft, after which it will adapted itself to the latter.

Said gear rack 24 is guided in a recess in the turret which is made with a protruding overhead guard 37 which protects the hook and the gear rack from above against foreign objects. A unit with a seat and foot plate for a crew member is also connected to the turret, which follows the movements of the turret in traverse. Elevation of the firearm takes place by means of the rod 38 (FIG. 1) which extends into the tank in a way which is known in itself.

The invention is not limited to the embodiments shown above as examples, but can be subject to modifications within the scope of the accompanying claims.

We claim:

1. An improved loading mechanism for a tank of the type having a large-caliber firearm located on the upper portion thereof, said firearm being arranged for movement about a vertical traverse axis and a horizontal elevation axis, said tank also having a magazine for rounds for said firearm mounted on said tank at a location spaced from said firearm, said mechanism comprising:

a round-receiving section for accepting rounds from said magazine;

means for pivotably supporting said round-receiving section at a location spaced from said elevation axis for movement between a round-receiving position at said magazine and a round-ramming position at said firearm;

means for rotating said pivotably supporting means together with said round-receiving section about said traverse axis independently of movement of said firearm about said traverse axis; and means for pivoting said round-receiving portion upwardly about said pivotably supporting means, whereby said round-receiving section may receive a round at said magazine; be pivoted upwardly to a position above the body of said tank; be rotated about said traverse axis to the traverse position of said firearm; be pivoted upwardly further to said round-ramming position; and be returned to said round-receiving position.

2. A mechanism according to claim 1, wherein said means for pivotably supporting said round-receiving section comprises a loading pendulum pivoted at one end at a location spaced from said elevation axis and pivotably attached to said round receiving section at the other end.

3. A mechanism according to claim 2, wherein said loading pendulum is pivoted at a location below and radially spaced from said elevation axis, further comprising means for guiding said pendulum between the top of said tank and the lower parts of said firearm.

4. A mechanism according to claim 2, wherein said means for rotating said pivotably supporting means about said traverse axis moves said loading pendulum along an arc located in a plane perpendicular to said traverse axis.

5. A mechanism according to claim 3, wherein said means for rotating said pivotably supporting means about said traverse axis moves said loading pendulum along an arc located in a plane-perpendicular to said traverse axis.

6. A mechanism according to claim 4, wherein said means for rotating said pivotably supporting means comprises a bearing ring surrounding said traverse axis, on which said pendulum pivots about said traverse axis.

7. A mechanism according to claim 6, wherein said tank further comprises a small turret having a trunnion cradle for said firearm on the upper end thereof, said turret being mounted for movement about said traverse axis; and said bearing ring is arranged between said turret and a frame in said tank which supports said turret.

8. A mechanism according to claim 4, wherein the other end of said loading pendulum has a fork-shaped section and said round-receiving portion is rotatably fastened between the prongs of said fork-shaped section.

9. A mechanism according to claim 5, wherein the other end of said loading pendulum has a fork-shaped section and said round-receiving portion is rotatably fastened between the prongs of said fork-shaped section.

10. A mechanism according to claim 6, wherein the other end of said loading pendulum has a fork-shaped section and said round-receiving portion is rotatably fastened between the prongs of said fork-shaped section.

11. A mechanism according to claim 7, wherein the other end of said loading pendulum has a fork-shaped section and said round-receiving portion is rotatably fastened between the prongs of said fork-shaped section.

12. A mechanism according to claim 4, wherein said means for rotating said pivotably supporting means comprises a fixed, circular slide track mounted on said tank with said traverse axis at its center, and a wheel on said loading pendulum for rolling along said slide track as said pendulum moves in traverse.

13. A mechanism according to claim 5, wherein said means for rotating said pivotably supporting means comprises a fixed, circular slide track mounted on said tank with said traverse axis at its center, and a wheel on said loading pendulum for rolling along said slide track as said pendulum moves in traverse.

14. A mechanism according to claim 6, wherein said means for rotating said pivotably supporting means comprises a fixed, circular slide track mounted on said tank with said traverse axis at its center, and a wheel on said loading pendulum for rolling along said slide track as said pendulum moves in traverse.

15. A mechanism according to claim 7, wherein said means for rotating said pivotably supporting means comprises a fixed, circular slide track mounted on said tank with said traverse axis at its center, and a wheel on said loading pendulum for rolling along said slide track as said pendulum moves in traverse.

16. A mechanism according to claim 8, wherein said means for rotating said pivotably supporting means comprises a fixed, circular slide track mounted on said tank with said traverse axis at its center, and a wheel on said loading pendulum for rolling along said slide track as said pendulum moves in traverse.

17. A mechanism according to claim 9, wherein said means for rotating said pivotably supporting means comprises a fixed, circular slide track mounted on said tank with said traverse axis at its center, and a wheel on said loading pendulum for rolling along said slide track as said pendulum moves in traverse.

18. A mechanism according to claim 10, wherein said means for rotating said pivotably supporting means comprises a fixed, circular slide track mounted on said tank with said traverse axis at its center, and a wheel on said loading pendulum for rolling along said slide track as said pendulum moves in traverse.

19. A mechanism according to claim 12, wherein said tank comprises a recessed shaft into which at least said round-receiving section is lowered to receive a round from said magazine and means for covering said shaft while a round is being received.

20. A mechansim according to claim 13, wherein said tank comprises a recessed shaft into which at least said round-receiving section is lowered to receive a round from said magazine and means for covering said shaft while a round is being received.

21. A mechanism according to claim 14, wherein said tank comprises a recessed shaft into which at least said round-receiving section is lowered to receive a round from said magazine and means for covering said shaft while a round is being received.

22. A mechanism according to claim 15, wherein said tank comprises a recessed shaft into which at least said round-receiving section is lowered to receive a round from said magazine and means for covering said shaft while a round is being received.

23. A mechanism according to claim 16, wherein said tank comprises a recessed shaft into which at least said round-receiving section is lowered to receive a round from said magazine and means for covering said shaft while a round is being received.

24. A mechanism according to claim 17, wherein said tank comprises a recessed shaft into which at least said round-receiving section is lowered to receive a round from said magazine and means for covering said shaft while a round is being received.

25. A mechanism according to claim 18, wherein said tank comprises a recessed shaft into which at least said round-receiving section is lowered to receive a round from said magazine and means for covering said shaft while a round is being received.

26. A mechanism according to claim 12, wherein said slide track comprises a section which can be lowered and raised to move said loading pendulum to and from a position for receiving rounds from said magazine and means for selectively moving said section, so that in its raised position said section comprises a part of said track and in its lowered position said pendulum may move down past said track.

27. A mechanism according to claim 13, wherein said slide track comprises a section which can be lowered and raised to move said loading pendulum to and from a position for receiving rounds from said magazine and means for selectively moving said section, so that in its raised position said section comprises a part of said track and in its lowered position said pendulum may move down past said track.

28. A mechanism according to claim 14, wherein said slide track comprises a section which can be lowered and raised to move said loading pendulum to and from a position for receiving rounds from said magazine and means for selectively moving said section, so that in its raised position said section comprises a part of said track and in its lowered position said pendulum may move down past said track.

29. A mechansim according to claim 15, wherein said slide track comprises a section which can be lowered and raised to move said loading pendulum to and from a position for receiving rounds from said magazine and means for selectively moving said section, so that in its raised position said section comprises a part of said track and in its lowered position said pendulum may move down past said track.

30. A mechanism according to claim 16, wherein said slide track comprises a section which can be lowered and raised to move said loading pendulum to and from a position for receiving rounds from said magazine and means for selectively moving said section, so that in its raised position said section comprises a part of said track and in its lowered position said pendulum may move down past said track.

31. A mechanism according to claim 17, wherein said slide track comprises a section which can be lowered and raised to move said loading pendulum to and from a position for receiving rounds from said magazine and means for selectively moving said section, so that in its raised position said section comprises a part of said track and in its lowered position said pendulum may move down past said track.

32. A mechanism according to claim 18, wherein said slide track comprises a section which can be lowered and raised to move said loading pendulum to and from a position for receiving rounds from said magazine and means for selectively moving said section, so that in its raised position said section comprises a part of said track and in its lowered position said pendulum may move down past said track.

33. A mechanism according to claim 19, wherein said slide track comprises a section which can be lowered and raised to move said loading pendulum to and from a position for receiving rounds from said magazine and means for selectively moving said section, so that in its raised position said section comprises a part of said track and in its lowered position said pendulum may move down past said track.

34. A mechanism according to claim 20, wherein said slide track comprises a section which can be lowered and raised to move said loading pendulum to and from a position for receiving rounds from said magazine and means for selectively moving said section, so that in its raised position said section comprises a part of said track and in its lowered position said pendulum may move down past said track.

35. A mechanism according to claim 21, wherein said slide track comprises a section which can be lowered and raised to move said loading pendulum to and from a position for receiving rounds from said magazine and means for selectively moving said section, so that in its raised position said section comprises a part of said track and in its lowered position said pendulum may move down past said track.

36. A mechanism according to claim 22, wherein said slide track comprises a section which can be lowered and raised to move said loading pendulum to and from a position for receiving rounds from said magazine and means for selectively moving said section, so that in its raised position said section comprises a part of said track and in its lowered position said pendulum may move down past said track.

37. A mechanism according to claim 23, wherein said slide track comprises a section which can be lowered and raised to move said loading pendulum to and from a position for receiving rounds from said magazine and means for selectively moving said section, so that in its raised position said section comprises a part of said track and in its lowered position said pendulum may move down past said track.

38. A mechanism according to claim 24, wherein said slide track comprises a section which can be lowered and raised to move said loading pendulum to and from a position for receiving rounds from said magazine and means for selectively moving said section, so that in its raised position said section comprises a part of said track and in its lowered position said pendulum may move down past said track.

39. A mechanism according to claim 25, wherein said slide track comprises a section which can be lowered and raised to move said loading pendulum to and from a position for receiving rounds from said magazine and means for selectively moving said section, so that in its raised position said section comprises a part of said track and in its lowered position said pendulum may move down past said track.

40. A mechanism according to claim 26, wherein said wheel is located at about one third of the length of said loading pendulum from said one end.

41. A mechanism according to claim 27, wherein said wheel is located at about one third of the length of said loading pendulum from said one end.

42. A mechanism according to claim 28, wherein said wheel is located at about one third of the length of said loading pendulum from said one end.

43. A mechanism according to claim 29, wherein said wheel is located at about one third of the length of said loading pendulum from said one end.

44. A mechanism according to claim 30, wherein said wheel is located at about one third of the length of said loading pendulum from said one end.

45. A mechanism according to claim 31, wherein said wheel is located at about one third of the length of said loading pendulum from said one end.

46. A mechanism according to claim 32, wherein said wheel is located at about one third of the length of said loading pendulum from said one end.

47. A mechanism according to claim 33, wherein said wheel is located at about one third of the length of said loading pendulum from said one end.

48. A mechanism according to claim 34, wherein said wheel is located at about one third of the length of said loading pendulum from said one end.

49. A mechanism according to claim 35, wherein said wheel is located at about one third of the length of said loading pendulum from said one end.

50. A mechanism according to claim 36, wherein said wheel is located at about one third of the length of said loading pendulum from said one end.

51. A mechanism according to claim 37, wherein said wheel is located at about one third of the length of said loading pendulum from said one end.

52. A mechanism according to claim 38, wherein said wheel is located at about one third of the length of said loading pendulum from said one end.

53. A mechanism according to claim 39, wherein said wheel is located at about one third of the length of said loading pendulum from said one end.

54. A mechanism according to claim 2, further comprising spring means connected between said loading pendulum and said round-receiving section for maintaining said round-receiving section in an essentially parallel orientation relative to the longitudinal direction of said firearm.

55. A mechanism according to claim 8, further comprising spring means connected between said loading pendulum and said round-receiving section for maintaining said round-receiving section in an essentially parallel orientation relative to the longitudinal direction of said firearm.

56. A mechansim according to claim 9, further comprising spring means connected between said loading pendulum and said round-receiving section for maintaining said round-receiving section in an essentially parallel orientation relative to the longitudinal direction of said firearm.

57. A mechanism according to claim 10, further comprising spring means connected between said loading pendulum and said round-receiving section for maintaining said round-receiving section in an essentially parallel orientation relative to the longitudinal direction of said firearm.

58. A mechanism according to claim 11, further comprising spring means connected between said loading pendulum and said round-receiving section for maintaining said round-receiving section in an essentially parallel orientation relative to the longitudinal direction of said firearm.

59. A mechanism according to claim 2, further comprising means for raising said loading pendulum to said round-ramming position when said pendulum reaches the traverse position of said firearm.

60. A mechanism according to claim 3, further comprising means for raising said loading pendulum to said round-ramming position when said pendulum reaches the traverse position of said firearm.

61. A mechanism according to claim 4, further comprising means for raising said loading pendulum to said round-ramming position when said pendulum reaches the traverse position of said firearm.

62. A mechanism according to claim 5, further comprising means for raising said loading pendulum to said round-ramming position when said pendulum reaches the traverse position of said firearm.

63. A mechanism according to claim 26, further comprising means for raising said loading pendumlum to said round-ramming position when said pendulum reaches the traverse position of said firearm.

64. A mechanism according to claim 59, wherein said means for raising comprises a hook moveable with said firearm and a member operatively connected to said one end of said pendulum and engageable with said hook when said pendulum reaches the traverse position of said firearm, whereby movement of said hook rotates said pendulum upward to said round-ramming position.

65. A mechanism according to claim 60, wherein said means for raising comprises a hook moveable with said firearm and a member operatively connected to said one end of said pendulum and engageable with said hook when said pendulum reaches the traverse position of said firearm, whereby movement of said hook rotates said pendulum upward to said round-ramming position.

66. A mechanism according to claim 61, wherein said means for raising comprises a hook moveable with said firearm and a member operatively connected to said one end of said pendulum and engageable with said hook when said pendulum reaches the traverse position of said firearm, whereby movement of said hook rotates said pendulum upward to said round-ramming position.

67. A mechanism according to claim 62, wherein said means for raising comprises a hook moveable with said firearm and a member operatively connected to said one end of said pendulum and engageable with said hook when said pendulum reaches the traverse position of said firearm, whereby movement of said hook rotates said pendulum upward to said round-ramming position.

68. A mechanism according to claim 63, wherein said means for raising comprises a hook moveable with said firearm and a member operatively connected to said one end of said pendulum and engageable with said hook when said pendulum reaches the traverse position of said firearm, whereby movement of said hook rotates said pendulum upward to said round-ramming position.

69. A mechanism according to claim 64, wherein said hook is mounted on a rack gear arranged to be translated by a motor.

70. A mechanism according to claim 65, wherein said hook is mounted on a rack gear arranged to be translated by motor.

71. A mechanism according to claim 66, wherein said hook is mounted on a rack gear arranged to be translated by a motor.

72. A mechanism according to claim 67, wherein said hook is mounted on a rack gear arranged to be translated by a motor.

73. A mechanism according to claim 68, wherein said hook is mounted on a rack gear arranged to be translated by a motor.

74. A mechanism according to claim 1, wherein said firearm comprises a two-stage rammer having a first ramming arm which displaces a round a first distance from said round-receiving section and a second ramming arm which displaces said round the remaining distance out of said round-receiving section and into said firearm.

75. A mechanism according to claim 2, wherein said firearm further comprises a breech housing having hinged sealing covers on its underside which are pushed aside by said loading pendulum as it approaches said round-ramming position.

* * * * *